US010472167B2

(12) United States Patent
Steinert et al.

(10) Patent No.: US 10,472,167 B2
(45) Date of Patent: Nov. 12, 2019

(54) AIR FREIGHT CONTAINER AND/OR AIR FREIGHT PALLET

(71) Applicant: Deutsche Post AG, Bonn (DE)

(72) Inventors: Frank Steinert, Lohmar (DE); Thomas Anderson, Bonn (DE); Sandra Blume, Bonn (DE)

(73) Assignee: Deutsche Post AG, Bonn (DE)

( * ) Notice: Subject to any disclaimer, the term of this patent is extended or adjusted under 35 U.S.C. 154(b) by 17 days.

(21) Appl. No.: 15/328,081

(22) PCT Filed: Jul. 21, 2015

(86) PCT No.: PCT/EP2015/066597
§ 371 (c)(1),
(2) Date: Jan. 23, 2017

(87) PCT Pub. No.: WO2016/012421
PCT Pub. Date: Jan. 28, 2016

(65) Prior Publication Data

US 2017/0210555 A1 Jul. 27, 2017

(30) Foreign Application Priority Data

Jul. 24, 2014 (DE) ..... 10 2014 110 478

(51) Int. Cl.
*B65D 88/14* (2006.01)
*B65D 19/44* (2006.01)
*B65D 90/00* (2006.01)

(52) U.S. Cl.
CPC ..... *B65D 88/14* (2013.01); *B65D 19/44* (2013.01); *B65D 90/006* (2013.01); *B65D 90/0053* (2013.01); *B65D 2519/00815* (2013.01)

(58) Field of Classification Search
CPC .. B65D 88/14; B65D 90/006; B65D 90/0053; B65D 19/44; B65D 2519/00815
(Continued)

(56) References Cited

U.S. PATENT DOCUMENTS 3,212,457 A * 10/1965 Looker ..... B60P 7/0815 244/115
3,502,205 A 3/1970 Milton
(Continued)

FOREIGN PATENT DOCUMENTS

DE 1964772 A1 7/1971
DE 20305197 U1 7/2003
(Continued)

OTHER PUBLICATIONS

International Search Report from related PCT/EP2015/066597 dated Sep. 16, 2015.
(Continued)

*Primary Examiner* — Michael Safavi
(74) *Attorney, Agent, or Firm* — Woodard, Emhardt, Henry, Reeves & Wagner, LLP

(57) ABSTRACT

The invention relates to an air freight container and/or air freight pallet with a flat bottom wall and/or side wall, at least two guide devices arranged on the bottom wall and/or side wall, two connecting elements, wherein a fastening region assigned to a first end of the connecting element in each case extends over part of the connecting element, and a fixing element for fixing an item to be transported transportable by means of the air freight container and/or air freight pallet, wherein the fixing element is connected at the first end thereof to the fastening region of one connecting element and at the second end thereof, which is opposite the first end, is connected to the fastening region of the other connecting element, the connecting elements each have, at a second end
(Continued)

arranged opposite the first end, a latching device designed for latching into the corresponding guide device, and at least one guide device is formed in such a way that the latching device can be latched into the guide device at different, spaced-apart positions along the planar extent of the bottom wall and/or side wall.

14 Claims, 5 Drawing Sheets

(58) Field of Classification Search
USPC ..... 248/346.03, 346.06, 346.07; 410/96, 410/105, 139, 153
See application file for complete search history.

(56) References Cited

U.S. PATENT DOCUMENTS 3,628,467 A * 12/1971 Stout ..... B60P 7/0815 410/55
3,986,459 A * 10/1976 Riley ..... B60N 2/0715 105/345
4,020,770 A * 5/1977 McLennan ..... B60P 7/0815 248/346.01
4,124,119 A * 11/1978 Nordstrom ..... B60P 3/08 206/335
4,185,799 A * 1/1980 Richards, Jr. ..... B64C 1/20 244/118.5
4,475,704 A * 10/1984 Marom ..... B65D 19/06 108/55.1
4,952,114 A 8/1990 Langer
5,310,297 A 5/1994 Benjamin
5,337,979 A * 8/1994 Bales ..... B64D 11/0696 244/118.1
5,489,172 A * 2/1996 Michler ..... B64C 1/20 244/118.1
5,520,357 A * 5/1996 Payne ..... B61D 45/006 244/118.1
5,772,369 A * 6/1998 Lerman ..... B65B 11/025 108/55.5
6,524,043 B2 * 2/2003 Earle ..... B60P 7/14 410/121
6,789,988 B1 * 9/2004 Moradians ..... B60P 7/0815 248/503
7,318,695 B2 * 1/2008 Yu ..... B60P 7/0815 410/105
7,473,062 B2 * 1/2009 Laflamme ..... B60P 7/0892 410/108
8,091,198 B2 1/2012 Lauzier
8,182,183 B2 * 5/2012 Cook ..... B60N 2/01558 244/118.1
8,282,326 B2 * 10/2012 Krostue ..... B64D 9/003 410/101
8,337,127 B2 * 12/2012 Moradians ..... B60P 7/0815 410/101
8,371,781 B2 * 2/2013 Roy ..... B64D 11/0696 410/104
2004/0218276 A1 11/2004 Apps
2008/0019789 A1 * 1/2008 Dunaway ..... G09F 3/0305 410/105
2009/0267280 A1 10/2009 Lauzier

FOREIGN PATENT DOCUMENTS

EP 0 332 060 A2 9/1989
EP 2 607 257 A1 6/2013
JP 2001080644 A 3/2001
WO WO 2008/110328 * 9/2008 ..... B65D 88/14
WO WO 2013/103300 A1 7/2013

OTHER PUBLICATIONS

Machine Translation of DE1964772A1 by Lexis Nexis Total Patent on Jan. 12, 2017.
Allsafe Jungfalk—Allsafe Aerospace—Sicherheit Made in Germany, Engen, Germany, Apr. 2013 (pp. 38).
Machine translation of abstract and claims for DE20305197U1 by Lexis Nexis Total Patent on Jun. 13, 2018.
Machine translation of JP2001080644A by Lexis Nexis Total Patent on Jun. 13, 2018.

* cited by examiner

AIR FREIGHT CONTAINER AND/OR AIR FREIGHT PALLET

BACKGROUND

The invention relates to an air freight container and/or an air freight pallet with a planar bottom wall and/or side wall and at least two guide devices arranged on the bottom wall and/or side wall.

Air freight containers are known from the prior art in various embodiments and are used in general to transport large quantities of mail items, luggage, freight, parcels, or other transportable goods as items to be transported bundled together in large units in aircraft. In the specialist terminology, air freight containers are referred to as unit load devices or ULDs for short and are embodied on the one hand as pallets or on the other hand as containers. A ULD container is generally formed as a closed container made of sheet aluminium with a profile frame, or a as a combination of aluminium frame with plastic walls. The items to be transported or cargo can be loaded and unloaded into/from the ULD container through a closable opening. In the case of a ULD pallet, a base wall is usually formed from a panel made of sheet aluminium with a substructure of profiles, wherein eyelets for fastening freight nets in order to secure the items to be transported arrangeable on the bottom wall are arranged at the edges of the bottom wall. Since a large number of individual items are transported as units bundled in a ULD container and/or on a ULD pallet, fewer individual mail items on the whole have to be handled during the loading and unloading of the aircraft, thus saving ground staff, time, and money.

On account of the generally very strict safety requirements in the field of air travel, ULD containers and ULD pallets, also referred to hereinafter as air freight containers or air freight pallets, or as containers or pallets for short, must be certified for an aircraft type. Specific container and pallet types have thus been developed which differ from one another in terms of their dimensions, the volume transportable in the container or on the pallet, and the aircraft type for which the container or the pallet is certified. Modifications to existing certified container or pallet types are very complex, since a new, very costly and time-consuming certification process has to be carried out for almost any modification. Depending on the particular transport volume and transport weight, it is therefore also not possible to use just any, specifically adapted and/or constructed air freight containers or air freight pallets. This, however, means that in practice it is not uncommon for air freight containers or air freight pallets that are only partly loaded to be transported by aircraft. Since the cost for shipping the items to be transported is calculated not only by weight, but also by transported volume, which is measured by the volume of the air freight container or the air freight pallet and not by the volume of the actual items to be transported, such a drawback is doubly annoying.

A further problem of air freight containers that are only partly filled or air freight pallets that are only partly loaded is that, with the existing possibilities, the items transported in the air freight container or on the air freight pallet cannot be particularly effectively secured against damage caused by slipping or falling during the flight. There are also certain items which can be stacked vertically only to a limited extent or which must be separated imperatively from other items during transport. False bottoms installed fixedly in air freight containers or space dividers installed fixedly on the air freight pallets, however, do no constitute an effective solution to this problem, since the false bottoms or the space dividers make it impossible to transport large-volume goods.

SUMMARY

Proceeding from the problem areas presented above, the object of the invention is to specify an air freight container and/or pallet which on the one hand enables a flexible and reliable securing of the items transported therein or thereon respectively and/or on the other hand enables a flexible and simple segmentation of the transport volume in order to achieve a high packing density. In particular, the object of the invention is to solve the aforementioned problems.

The problem is solved in accordance with the invention by the features of the independent claim. Advantageous embodiments of the invention are specified in the dependent claims.

The solution to the problem is therefore provided by an air freight container and/or an air freight pallet with a planar bottom wall and/or side wall, two guide devices arranged on the bottom wall and/or side wall, at least two connecting elements, wherein a fastening region assigned to a first end of the connecting element in each case extends over part of the connecting element, and a fixing element for fixing items transportable by means of the air freight container and/or pallet, wherein the fixing element is connected at the first end thereof to the fastening region of one connecting element and is connected at its second end, which is opposite the first end, to the fastening region of the other connecting element, the connecting elements each have, at a second end arranged opposite the first end, a latching device designed for latching into the corresponding guide device, and at least one guide device is designed in such a way that the latching device can be latched into the guide device at different, spaced-apart positions along the planar extent of the bottom wall and/or side wall.

A key point of the invention thus lies in the provision of the connecting elements and the fixing element, whereby the items transportable by means of the air freight container and/or by means of the air freight pallet on the one hand can be segmented according to volume and on the other hand can be fixed to the air freight container and/or the air freight pallet so as to be secured against slipping. Particularly when transporting hazardous items, it is necessary to secure the items in the air freight container or on the air freight pallet against slipping during transport, which in particular applies when the air freight container or the air freight pallet is not fully loaded. Due to the proposed embodiment, however, the items can be secured during transport in a particularly simple and efficient manner so as to thus meet the requirements of the Aviation Safety Authority for the granting of a permit in particular for the transport of hazardous goods.

A further advantage of the proposed embodiment is that the proportion of items damaged during transport is reduced on account of the securing against slipping made possible by the invention, and compensation payments to shippers of the items can thus be reduced on account of the resultant fewer instances of damage. Since the connecting elements can be latched with the fixing element into the guide devices by means of the latching devices, the items to be transported can be fixed in a particularly flexible and quick manner. In addition, the proposed solution also contributes to an increase in the packing density of the items to be transported, such that on the one hand an interior of the air freight container or a loading area of the air freight pallet can be divided according to volume, but on the other hand, by means of the connecting elements and the fixing element, it is also possible to secure items already introduced into the air freight container or arranged on the air freight pallet against slipping during transport.

In accordance with a preferred development, the connecting elements are designed such that the fixing element can be fixed to the fixing elements in a plurality of positions spaced differently from the first end of the fixing elements. This means that the fixing element can thus be fixed to the connecting elements at different heights or distances from the bottom wall and/or side wall, i.e. in particular in discrete positions. Provision can also be made so that the fixing element on the one hand can be fixed flush to an edge of the connecting element arranged at a first end, but on the other hand can also be fixed in a variety of different discrete or continuous positions beneath the edge. Various possibilities exist for fixing, for example fastening means such as screws or split pins, which, when guided through an opening in the connecting element, prevent the fixing element from slipping relative to the connecting element.

The connecting element is preferably designed as a round bar, shaft, or tube, and for example has a linear extent of 10 cm, 20 cm, 30 cm, 40 cm or 50 cm, or an extent of ≥5 cm and ≤60 cm, preferably ≥10 cm and ≤50 cm. In addition, the connecting element can also have a different profile in cross-section, for example a rectangle-like or rectangular profile. The fixing element is preferably designed in cross-section with a rectangle-like or rectangular profile and more preferably extends linearly between its first end and its second end. The fixing element preferably has, between its first end and its second end, an extent which is adapted to an extent of the bottom wall and/or side wall, for example which is 1%, 2%, 1 cm, 2 cm, or 3 cm shorter. The profile of the fixing element in cross-section even more preferably has a greater width than depth, for example has a width that is five time, six time, eight times, or ten times greater than the depth. The fixing element more preferably extends, in terms of its width, parallel to the extent of the connecting element between the two ends thereof. Since the fixing element can be fixed to the connecting element at different positions and/or the fixing element has a much greater width than depth, items to be transported of a wide range of different sizes and/or different volumes can be fixed in a flexible manner to the bottom wall and/or side wall.

There are various possibilities for connecting, or also arranging, the fixing element on the connecting element, wherein the fixing element particularly preferably has a hollow profile at both of its ends, which hollowed profile corresponds to the profile of the connecting element in the fastening region. If, by way of example, the connecting element is embodied as a shaft, the fixing element can also have a hollow tube at its two ends, which hollow tube has an inner cross-section that is slightly larger than the outer cross-section of the connecting element in the fastening region. Designed in this way, the fixing element can slide over the connecting element between the first end and the second end and can be fixed on the connecting element in various positions with different distances between the fixing element and both the first end and the second end, for example by means of two split pins guided through the connecting element and restricting the fixing element at the connecting element.

In accordance with yet a further embodiment, the connecting elements are in each case arranged on the latching devices in a pivotable manner, in particular the connecting elements can be pivoted, in respect of their longitudinal extent, in a plane perpendicular to a longitudinal extent of the guide devices. The connecting elements preferably can be pivoted through an angle of 180° or 90°, and therefore, in the case of 90°, for example between a position in which the connecting elements extend in their longitudinal extent parallel to the planar extent of the bottom wall and/or side wall and a position in which the connecting elements extend in terms of their longitudinal extent perpendicularly to the planar extent of the bottom wall and/or side wall. In the latter position, the connecting elements preferably can be latched into the latching devices, such that the connecting elements, including the fixing element, remain in said position. On the other hand, the proposed embodiment allows the connecting elements, and therefore also the fixing element, to be easily tilted or pivoted away from an upright position, oriented at right angles to the planar extent of the bottom wall and/or side wall, into a pivoted position, in which the connecting elements and the fixing element extend in a plane parallel to the planar extent of the bottom wall and/or side wall. In the latter position, items to be transported can then be stacked on the connecting elements and also the fixing element. On the other hand, on account of the pivotability of the fixing element inclusive of the connecting elements, said elements can be particularly easily pivoted back into the upright position, so as to then secure loaded items against slipping, for example in the event that further items are then to be loaded. A U-shaped holder is particularly preferably provided on the latching device, in which holder the connecting element is held via its second end so as to be pivotable by means of a pivot pin forming the pivot axis. The pivot axis more preferably extends parallel to the longitudinal extent of the guide device.

In accordance with yet a further preferred embodiment, the connecting elements and the fixing element are designed in such a way that the fixing element is arranged, in its longitudinal extent, perpendicularly to a longitudinal extent of the connecting elements and/or the fixing element can be pivoted, in terms of its longitudinal extent, in a plane perpendicular to a longitudinal extent of the connecting elements. The fixing element preferably can be pivoted through an angle of 360° about the connecting element. In accordance with an embodiment of this type, provision can thus be made so that the fixing element, in respect of its longitudinal extent, is arranged at right angles to the longitudinal extent of the guide devices, for example when the angle is 90°, or, in the case of a length-variable embodiment of the fixing element, the fixing element, in respect of its longitudinal extent, forms an angle of, for example, 45° to the longitudinal extent of the guide devices. In this respect, the fixing element can be arranged in different positions in order to fix the items to be transported, in particular can thus be adapted individually and in a flexible manner in respect of the particular items. In accordance with the possible embodiments discussed above, the fixing device thus not only is height-adjustable in relation to the planar extent of the bottom wall and/or side wall, but also can be arranged, with respect to the longitudinal extent, in different angular positions relative to an edge of the bottom wall and/or side wall.

In accordance with a particularly preferred embodiment, the fixing element is length-adjustable between the first end and the second end. This embodiment also contributes to a particularly flexible and individual arrangement of the fixing element at the bottom wall and/or side wall, such that items to be transported of a wide range of different and variable sizes can be secured individually by the fixing element. In order to secure the items to be transported, the fixing element preferably bears with contact against the items. With regard to the embodiment of the length variability of the fixing element, various possibilities exist in principle. In accordance with a particularly preferred embodiment, the fixing element has a cross-section that in particular is rectangle-like, wherein at least a first part of the fixing element has a first cross-section, such that a second part of the fixing element can be slid into the first part and/or removed therefrom in order to vary the length of the fixing element. The fixing element more preferably has, between its first end and its second end, a first part assigned to the first end, a second part following on therefrom, and also a third part, which adjoins the second part and is assigned to the second end, wherein the third part has the first cross-section. The first part, the second part and/or the third part are/is preferably designed as a longitudinally extending rectangular profile or round profile, wherein the second part has an outer cross-section which is adapted to the inner cross-section of the first part and/or the third part, in such a way that the second part is guided non-pivotably through the first part and/or the third part, however the second part, inserted into the first part and/or the third part, can slide in a length-variable manner in the first part and/or the third part.

In accordance with yet a further preferred embodiment, the guide device, which can be designed as a guide rail and/or seat track guide or guide rail, extends along an edge of the bottom wall and/or side wall. The bottom wall and/or side wall are/is even more preferably rectangle-like, wherein the guide device extends along the entire edge of at least one rectangle side. Guide devices are particularly preferably arranged on two opposite edges and each extends along the corresponding edge. Here, the guide device on the one hand can extend directly at the edge, at a distance from the edge, or additionally or alternatively can extend in a middle region of the bottom wall and/or side wall. Both guide devices are more preferably designed in such a way that the latching devices each can be latched into the corresponding guide device at different, spaced-apart positions along the planar extent of the bottom wall and/or side wall.

The latching devices are preferably each latched at the same distance from one of the two transverse sides into the guide devices extending parallel to one another. It may also be that both latching devices are latched into the same guide device, spaced apart in accordance with the longitudinal extent of the fixing element. The latter embodiment is advantageous when the fixing element is to be fixed with the connecting elements at an edge of the bottom wall and/or top wall, such that the remaining part of the bottom wall and/or top wall can be loaded with items to be transported. The guide device even more preferably extends between a top side and a bottom side of the air freight container and/or at an edge of the bottom side, the top side and/or another side. The guide device even more preferably has a plurality of predefined positions, which for example are formed by milled recesses in the guide device. Provision can also be made so that the latching device can be latched into the guide device at any position between the first end and second end of the guide device. A segmentation of the items to be transported by means of the fixing device can thus be achieved in an extremely flexible manner. A plurality of fixing devices with corresponding connecting elements and latching devices can also be provided, such that the air freight container and/or the air freight pallet can be divided into a number of segments.

In accordance with a further preferred embodiment, the air freight container and/or the air freight pallet, within the scope of the invention also referred to generally as an air freight container or container, has a fixing device embodied in particular as a strap for fixing the connecting element and the fixing element, wherein the fixing device is arranged at its first end on the connecting element and/or on the fixing element and at its second end, which is opposite the first end, is designed to latch onto the guide device. The fixing device is preferably releasably connected at its first end to the connecting element or the fixing element, for example by means of yet a further guide device arranged on the retaining element and/or the fixing element and yet a further latching device arranged at the first end. The yet further guide device and the yet further latching device are preferably formed identically to the first-mentioned latching device and guide device. The strap is preferably formed from polyester, nylon and/or from a material having fireproof and/or fire-resistant properties and more preferably has a width of 20 mm, 25 mm, 1 inch, or 2 inches. The strap is even more preferably formed in accordance with the standard JAR25.853App.F, Part A1 IV and/or ASNA3573. The fixing device particularly preferably extends between its first end and its second end, at least in a tensioned state of the fixing device, at an angle of 30°, 45°, or 60° to the longitudinal extent of the guide device and/or the connecting element.

In accordance with yet a further preferred embodiment, a further guide device is provided on a side of the fixing element facing away from the bottom wall and/or side wall, wherein an at least triangular flat intermediate element made of a flexible material has, at least at one corner, a further latching device which can be latched into the further guide device and/or the first-mentioned guide device. The intermediate element is preferably formed from a textile fabric having a plurality of reinforcements formed and/or incorporated in the fabric, wherein the reinforcements are more preferably arranged periodically and extend over the entire length of the textile fabric, for example over the longitudinal extent of the textile fabric. The textile fabric is more preferably produced from natural fibres, from synthetic fibres, for example polyester, polyamide or aramide, or is produced from a mixture of the aforementioned fibres and is very particularly preferably fire-resistant or fireproof. The fabric even more preferably has a thickness of 2, 3, 5 or 7 mm. The intermediate element is very particularly preferably formed from a textile fabric, as a canvas and/or as a mesh which is certified for use in an aircraft.

Since the intermediate element is not fixedly connected to the air freight container, a certification is not necessary. The intermediate element is preferably formed from a material which meets the high requirements in respect of flammability, strength, and ageing resistance on board an aircraft. The reinforcements are even more preferably formed as glass fibre rods arranged parallel to one another and inserted and/or sewn into the fabric. The reinforcements are preferably arranged at a distance of 5 cm, 10 cm, 15 cm or 20 cm from one another and extend over 80%, 90%, 95% or 100% of the length of the intermediate element, i.e. in particular the longitudinal extent of the intermediate element. In addition to glass fibre rods, any other reinforcement elements can also be used. In any case, the rigidity of the intermediate element can be increased by the provision of reinforcements, such that the intermediate element can support greater loads.

A plurality of further guide devices is more preferably arranged on the fixing element in a manner spaced apart from one another over the longitudinal extent of the fixing element. A further latching device which can be latched into the further guide device is more preferably arranged at each corner of the intermediate element and/or between two adjacent corners of the intermediate element. The intermediate element is very particularly preferably rectangle-like, rectangular and/or square. A tensioning device is even more preferably provided on the intermediate element and can be used to tension the intermediate element. The intermediate element can be introduced in the air freight container for example in the horizontal or vertical extent and then can be connected within the air freight container by means of the latching device.

The intermediate element, instead of a false bottom and/or a space divider element fixedly installed in the air freight container, can thus enable a separation, fixing and/or covering of the items to be transported in a flexible and quick manner, such that the items can be fixed securely to the air freight container in order to achieve a high packing density by means of the intermediate element. Similarly to the fixing element, the intermediate element on the one hand can also create a division of the interior of the air freight container according to volume, and on the other hand items already introduced into the air freight container can be secured by the intermediate element against slipping during the transport. By way of example, it is thus possible to cover items already introduced in the air freight container with the intermediate element, which then is tensioned by means of the latching device fixed at the guide device until the intermediate element bears with contact against the items to be transported. For this purpose, in the case of a rectangle-like embodiment of the intermediate element with latching devices at all corners of the intermediate element, the intermediate element can connect to the fixing device for example at two corners, wherein the two opposite corners can be connected in turn to the bottom wall and/or side wall of the air freight container or are secured to a second fixing element.

The parts used or installed on board a freight and/or passenger aircraft, in order to gain approval, generally have to undergo a costly and time-consuming certification process. In accordance with a particularly preferred embodiment, provision is therefore made for the guide device to be formed as a seat track guide and for the latching device to be formed as a double stud or triple stud latching device for latching into the seat track guide, i.e. in accordance with a standard known to a person skilled in the art for approved and certified use on board aircraft. The guide device and/or the latching device are/is particularly preferably certified for use in aircraft, in particular a freight aircraft and/or passenger aircraft, for example in accordance with AS33601, NAS3610 and/or AS36100. The seat track guide is particularly preferably formed in combination with the double stud or triple stud latching device for a load of 44.45 kn/10,000 lbs. the guide device is more preferably screwed, adhered to, pressed into and/or riveted to the air freight container.

The embodiment of a guide device and/or latching device in accordance with a standard certified for air transport is particularly advantageous, since in this case the attachment in an air freight container which is also certified accordingly does not require a new certification. Since the intermediate element can be removed from the air freight container, i.e. is not permanently fixedly connected to the air freight container non-releasably, there is also no need for any certification for the intermediate element. This means that with use for air transport of a guide device and latching device that have already been certified, and also for the intermediate element not connected non-releasably to the air freight container, no certification is necessary for the use of the proposed air freight container in an aircraft.

In a very particularly preferred embodiment, the air freight container and/or the air freight pallet is embodied as a unit load device and, in the case of an air freight container, even more preferably as a closed container. The unit load device is even more preferably formed as an air freight container of the "Lower Deck Container" (LD), "Upper Deck Container" (UD) and/or "Main Deck Container" (MD) type, for example in accordance with the types LD1, LD2, LD3, LD6, LD7, LD8, LD9 or LD11, or M1 or M1H, or in the case of an air freight pallet is formed according to types LD8, LD11 or LD7 in the pallet variant. The air freight pallet preferably has just one bottom wall, which, in the case of the type LD8, extends for example over an area of 153×244 cm. In the case of an air freight container, the air freight container preferably has at least one side wall, which is arranged at right angles to the bottom wall. A top wall is preferably provided parallel to the bottom wall and also extends at right angles to the side wall. An opening is preferably provided on a front wall of the air freight container, through which opening the air freight container can be loaded with items to be transported, and unloaded of transported items. Alternatively or additionally, the opening can be provided on the rear wall. A rear wall arranged opposite the front wall can have a curved cross-sectional shape in order to achieve the best adaptation possible to a curved aircraft fuselage. In this respect, the air freight container, in a side view, can have a triangular, rounded form, wherein the rear wall and the top wall are formed in one part as a continuous bend. Pentagonal-like embodiments, in a side view, are also conventional, in which the top wall, front wall, bottom wall, and rear wall are arranged at right angles to one another and in addition a further rear wall side that is sloped relative to the rear wall is formed in an upper or lower rear region.

The bottom and/or side wall, the guide devices, the latching devices, the connecting elements and/or the fixing element are even more preferably made of aluminium, for example in accordance with the specification . . . T73511, for example 7075T73511, for extruded profiles or . . . T7351 for sheet aluminium, or in accordance with 7075T6, 7021T6 or 7020T6 or 6021T6. In addition, it is also possible that the bottom wall and/or side wall and also the rear wall comprise polycarbonates or fibrous fabrics, at least in part.

The invention will be explained in greater detail hereinafter with reference to the accompanying drawings on the basis of a preferred embodiment.

DETAILED DESCRIPTION OF THE DRAWINGS

Figure 1:
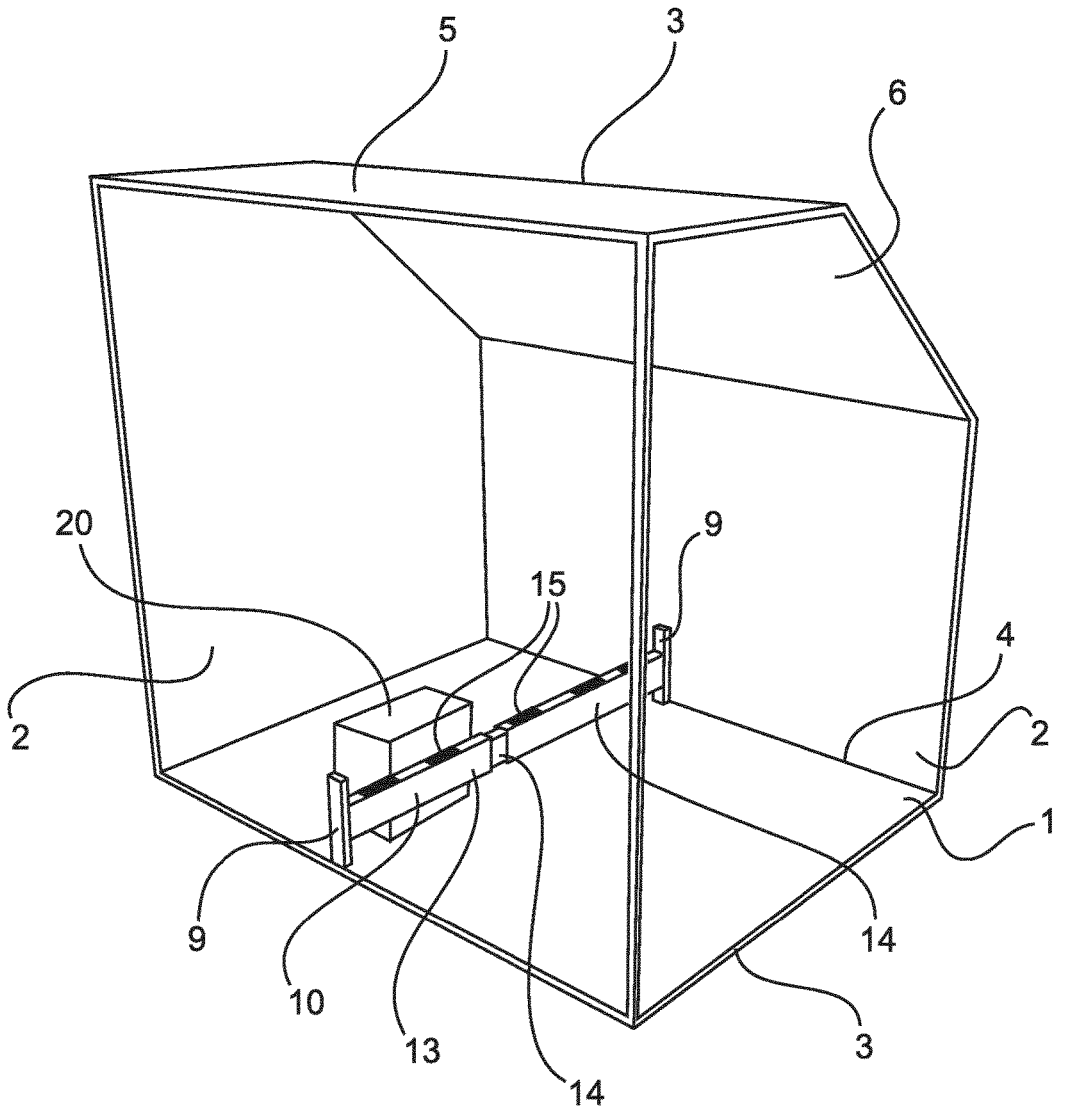
FIG. 1 shows an air freight container in accordance with a preferred embodiment of the invention in a schematic view.
Figure 2:
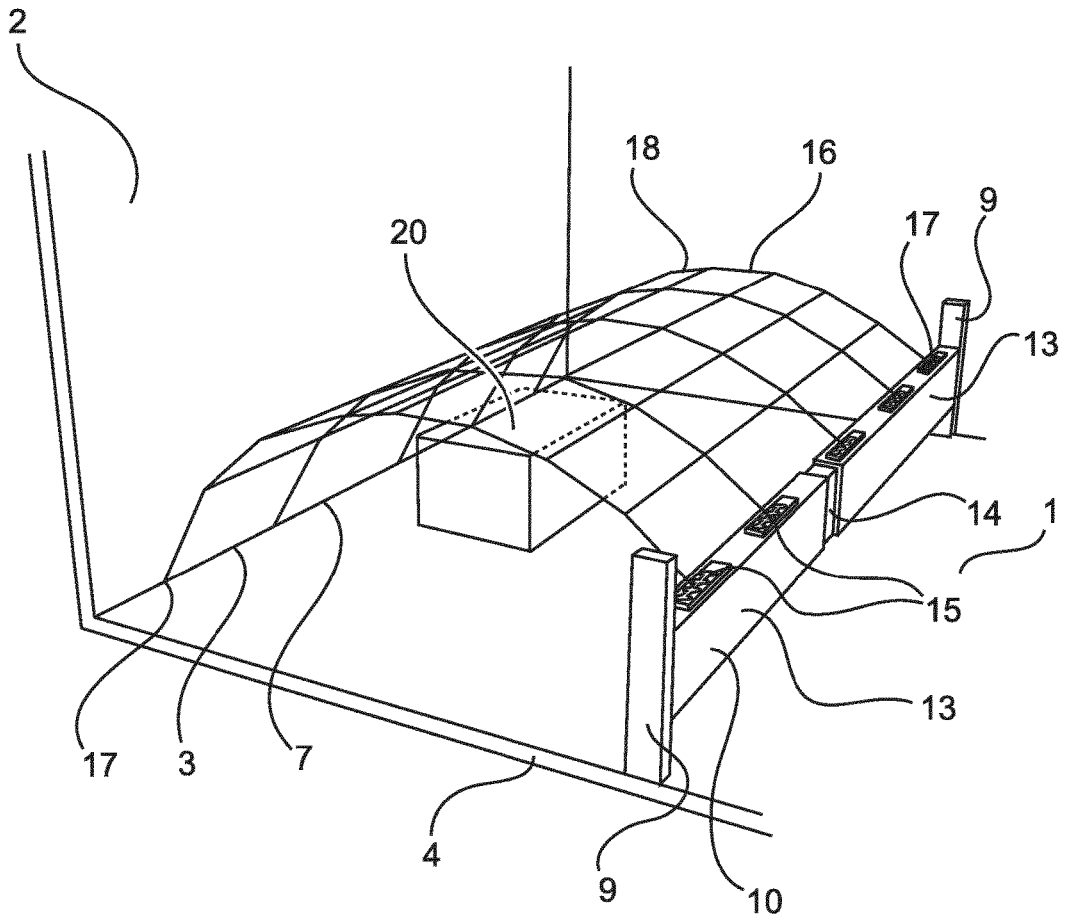
FIG. 2 shows a detail of the air freight container according to FIG. 1 with an intermediate element in a schematic view.

FIG. 1 shows an air freight container in accordance with a preferred embodiment of the invention in a schematic view. The air freight container has a planar bottom wall 1, with two planar side walls 2 extending at right angles thereto. The bottom wall 1 has a rectangular base area, wherein one side wall 2 adjoins a transverse side 3 of the bottom wall 1 and the other side wall 2, which is embodied as a rear wall, adjoins the longitudinal side 4. A top wall 5 is arranged at least partly covering the bottom wall 1. A rear wall side 6, which is adjoined by the side wall 2 formed as the rear wall, adjoins the transverse side 3 of the top wall 5. A third side wall 2, to the right in the drawing plane, which adjoins the rear wall 2, the bottom wall 1, the top wall 5 and the rear wall side 6, has been omitted in order to provide a better illustration. In a side view, i.e. when viewed from the front in the direction of the side wall 2 connected to the transverse side 3, the air freight container thus has a pentagonal shape.

Figure 5:
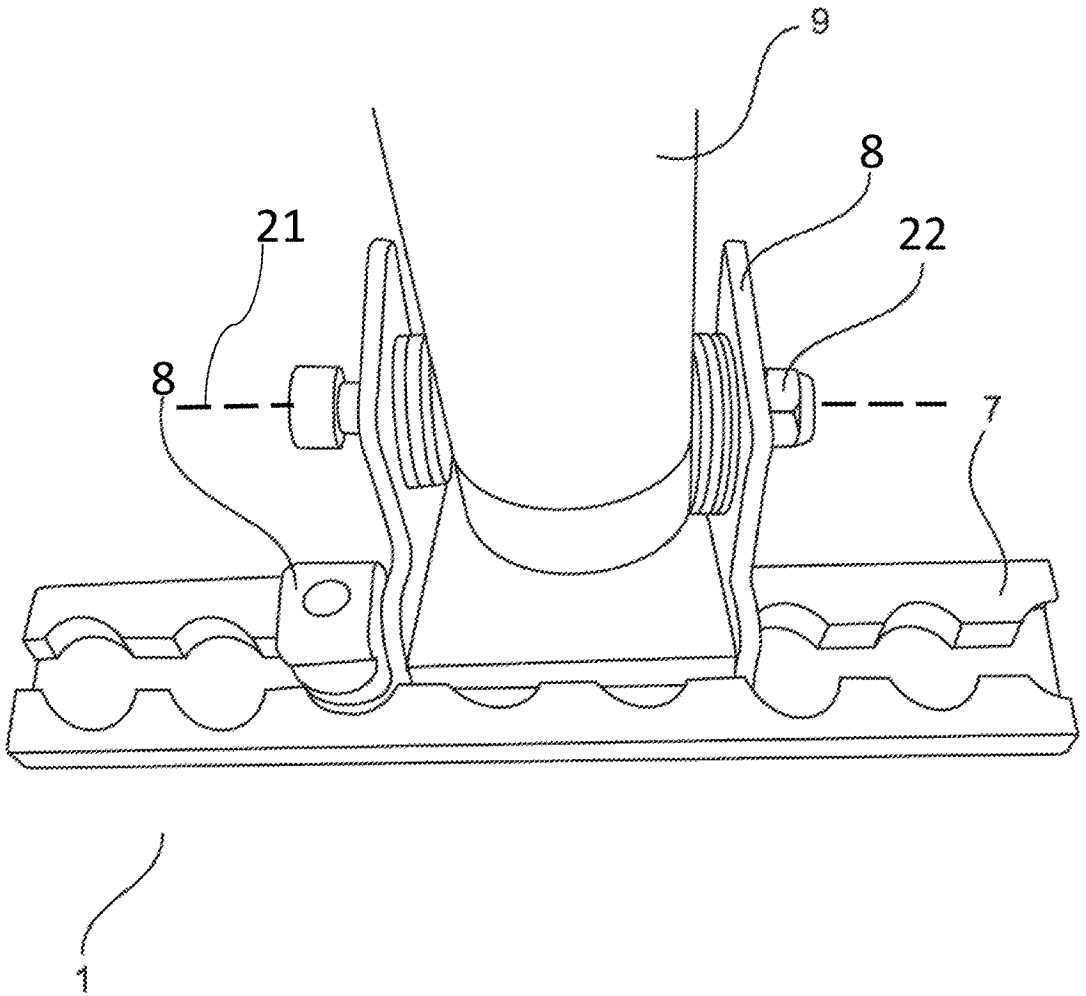
FIG. 5 shows a further detail of the air freight container according to FIG. 1 with a connecting element in a schematic view.

Guide devices 7 are fastened to the bottom wall 1 along the two longitudinal sides 4 of the bottom wall 1, wherein the guide devices 7 each extend along the entire longitudinal side 4. The guide devices 7, shown in detail by way of example in FIG. 5, are formed in the present case as a seat track guide in accordance with aviation standard AS33601, NAS3610 and/or AS36100. A latching device 8, which in the present case is formed as a double stud or triple stud latching device in accordance with the aforementioned standard, is latched into the corresponding guide device 7. Since the guide devices 7 each extend along the entire longitudinal side 4 at the two opposed edges of the bottom wall 1, the two shown latching devices 8 can be latched into the bottom wall 1 in a plurality of different, spaced-apart positions along the longitudinal extent 4.

Figure 3:
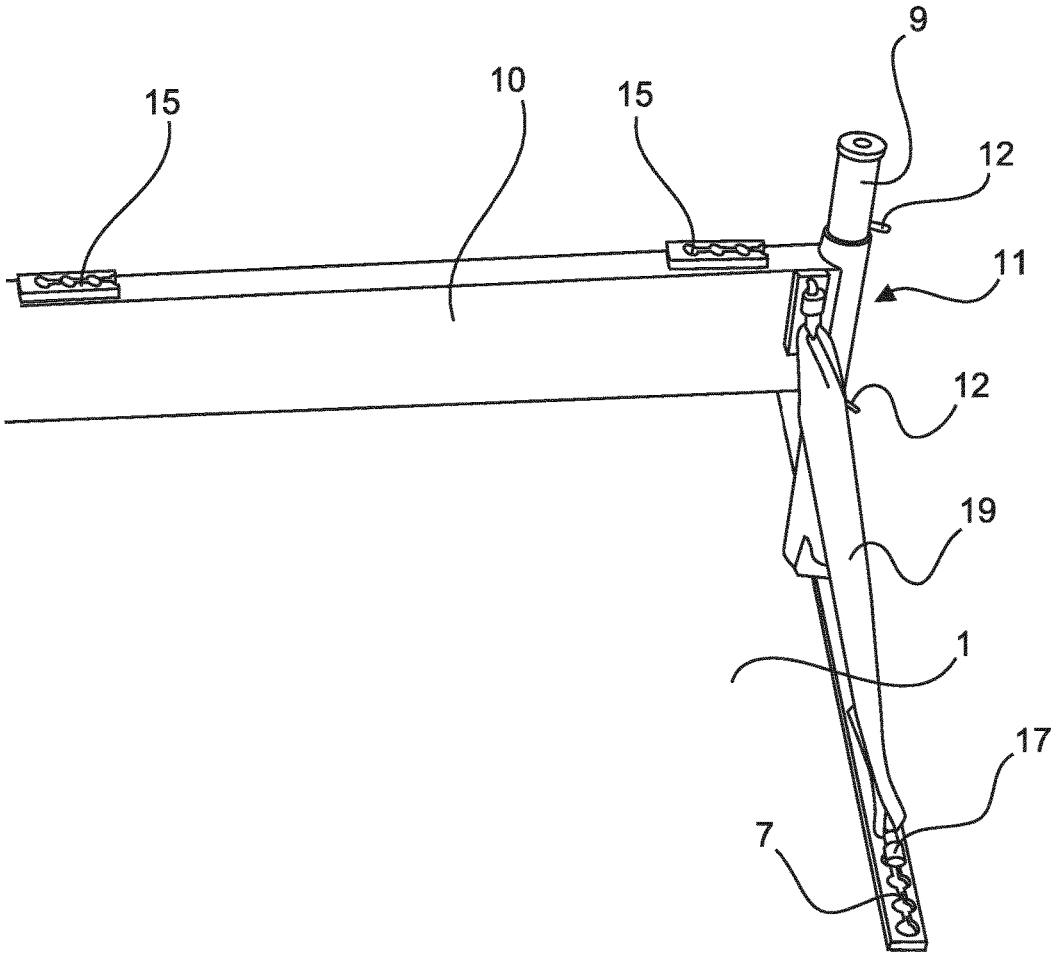
FIG. 3 shows a further detail of the air freight container according to FIG. 1 with a fixing element in a schematic view.
Figure 4:
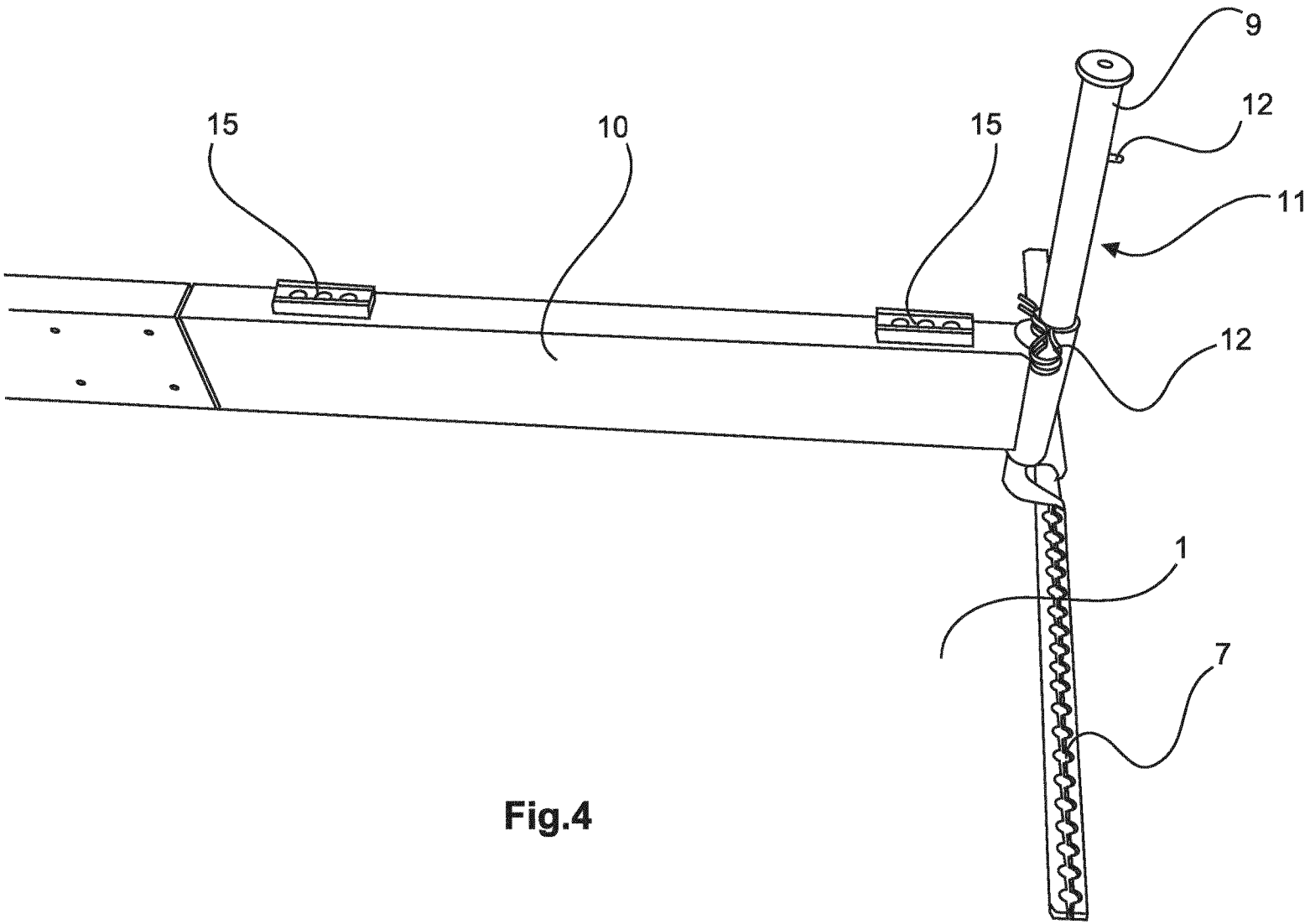
FIG. 4 shows the fixing element according to FIG. 3 in another position in a schematic view.

A connecting element 9, which, as can be seen from FIG. 3 and FIG. 4, extends linearly away from the latching device 8 over a length of 20 cm, is connected to the latching device 8. The connecting element 9 is connected to the latching device 8 pivotably at its second end shown in FIG. 5, in such a way that the pivot axis 21 leading through the connecting element 9 and the latching device 8 extends parallel to the direction of longitudinal extent of the guide device 7. The connecting element 9 is accordingly pivotable in a plane perpendicular to the direction of longitudinal extent of the connecting element 9. In the present case, the latching device 8 has a U-shaped opening, in which the second end of the connecting element 9 is held by means of a pin 22. In the position of the connecting element 9 shown in the Figures, this connecting element extends between its first and opposite second end in a manner perpendicular to the planar extension of the bottom wall 1 and perpendicularly to the longitudinal extent of the guide device 7. On account of the pivotability, however, the connecting element 9 can also be pivoted into a pivot position not shown, such that it extends, in its longitudinal extent, parallel to the planar extent of the bottom wall 1.

A fixing element 10 is arranged at right angles to the longitudinal extent of the connecting element 9 and is arranged on the connecting element 9 between the first end and the second end, i.e. in a height-adjustable manner relative to the bottom wall 1. Specifically, a fastening region 11 is provided on the connecting element 9 and extends over part of the connecting element 9. The fixing element 10 is connected at both ends thereof to the corresponding fastening region 11 of a corresponding connecting element 9. For this purpose, the connecting element 9 is formed in the present case as a shaft and the fixing element 10 is formed with a rectangular profile, wherein a round shaft, i.e. a tube, is welded to the rectangular profile at the two ends thereof facing the connecting elements 9, and the shafts of the connecting elements 9 are guided through said hollow tubes. Whereas in FIG. 4 the fixing element faces the bottom wall 1, in FIG. 3 a position of the fixing element 10 is shown in which the fixing element 10 faces away from the bottom wall 1. In order to fix the fixing element 10 to the connecting element 9 in the corresponding position relative to the bottom wall 1, two split pins 12 are provided. The split pins 12 are guided through the connecting element 9 in a manner spaced apart in the longitudinal extent and thus surround the round shaft of the fixing element 10 from both sides in order to fix this is to the connecting element 9.

The fixing element 10 is length-variable between its two ends connected to the two connecting elements 9. For this purpose, the fixing element 10 firstly has a first part 13 with a first rectangular cross-section, which is adjoined by a second part 14 with a second rectangular cross-section. The second part 14 is in turn adjoined by a further first part 13. The outer cross-section of the second part is slightly smaller than the inner cross-section of the first part 13, such that the second part 14 can be slid into the first part 13 and removed therefrom again in order to vary the length of the fixing element 10.

Further guide devices 15 are arranged in a spaced-apart manner on the fixing device 10 on a side facing away from the bottom wall 1 and in the present case are also formed as seat track guides. A square, planar intermediate element 16 is latched by means of further latching devices 17 into these further guide devices 15, i.e. into the fixing device 10 along one side of the intermediate element 16 and into a guide device 7, which is provided at an edge of the transverse side 3 of the bottom wall 1, on an opposite side of the intermediate element 16. The planar intermediate element 16 can be formed as a canvas, but in the present case is formed from a textile fabric in the form of a mesh, which comprises the textile rope 18. The intermediate element 16 is thus flexible and is designed to encompass the loaded items 20, i.e. mail items, in the most form-fitting manner possible and therefore to secure said items against slipping and movement. The further latching device 17 is formed in the present case as a tie down double stud fitting with link and ring, wherein a strap with clamping lock is arranged between the intermediate element 16 and each further latching device 17, such that the intermediate elements 16 can be tensioned on account of the changing length of the strap in order to secure items to be transported 20.

In order to fix the connecting element 9 in a position perpendicular in relation to the bottom wall 1, a fixing device 19 is provided, wherein the fixing device 19 is connected at its first end to the fixing element 10, and at its second, opposite end is latched into the guide device 7 by means of a further latching device 17. In this way, the fixing device 19 in accordance with the embodiment shown in FIG. 3 extends at an angle of 45° on the one hand to the longitudinal extent of the connecting element 9 and on the other hand to the longitudinal extent of the guide device 7. In the present case, the fixing device 19 is formed from a strap made of flame-resistant polyester and has a width of 2 inches.

As a result, by means of the proposed fixing element 10, items 20 to be transported by means of the air freight container or an air freight pallet can be secured in a particularly flexible way against slipping during the transport. Since the fixing device 10 on the one hand, as shown in FIG. 3 and FIG. 4, can be secured in a height-adjustable way to the connecting element 9 and on the other hand can be latched by means of the latching device 8 in different positions in guide devices 7 provided on the bottom wall 1, the fixing element can be arranged in a large number of different positions within the air freight container 1 in order to secure the items to be transported 20.

LIST OF REFERENCE SIGNS bottom wall 1
side wall 2
transverse side 3
longitudinal side 4
top wall 5
rear wall side 6
guide device 7
latching device 8
fixing element 10
fastening region 11
split pin 12
first part 13
second part 14
further guide device 15
intermediate element 16
further latching device 17
rope 18
fixing device 19
items to be transported 20
pivot axis 21
pin 22

The invention claimed is:

1. An unit load device with a flat bottom wall, at least two seat track guides approved and certified for use in an aircraft, formed in accordance with aviation standard AS33601, and arranged on the bottom wall, two connecting elements, wherein a fastening region assigned to a first end of the connecting element in each case extends over part of the connecting element, and a fixing element for fixing items to be transported transportable by means of the unit load device, a fixing device embodied as a strap for fixing the connecting element and the fixing element, wherein the fixing device is arranged at its first end on the connecting element, wherein the fixing element is connected at the first end thereof to the fastening region of one connecting element and at the second end thereof, which is opposite the first end, is connected to the fastening region of the other connecting element, the connecting elements each have, at a second end arranged opposite the first end, a double stud or triple stud latching device approved and certified for use in an aircraft, formed in accordance with aviation standard AS33601, and designed for latching into the corresponding seat track guide, and at least one seat track guide is formed in such a way that the double stud or triple stud latching device can be latched into the seat track guide at different, spaced-apart positions along the planar extent of the bottom wall, and wherein a further seat track guide is provided on a side of the fixing element facing away from the bottom wall, with an at least triangular planar intermediate element made of a flexible material, and wherein the intermediate element has, at least at one corner, a double stud or triple stud latching device which can be latched into the seat track guide and/or into the further seat track guide.

2. The unit load device according to claim 1, wherein the connecting elements are formed such that the fixing element can be fixed to the connecting elements at a plurality of positions spaced apart differently from the first end of the connecting elements.

3. The unit load device according to claim 1, wherein the connecting elements are each arranged pivotably on the double stud or triple stud latching devices.

4. The unit load device according to claim 1, wherein the connecting elements and the fixing element are formed in such a way that the fixing element is arranged, in its longitudinal extent, perpendicular to a longitudinal extent of the connecting elements.

5. The unit load device according to claim 1, wherein the fixing element is length-adjustable between the first end and the second end.

6. The unit load device according to claim 5, wherein the fixing element has a first cross-section which in particular is rectangle-like and at least one first part of the fixing element has a second cross-section, in such a way that a second part of the fixing element can be slid into the first part.

7. The unit load device according to claim 1, wherein the seat track guides extend along an edge of the bottom wall.

8. The unit load device according to claim 1, wherein the bottom wall, the seat track guides, the double stud or triple stud latching devices, the connecting elements and/or the fixing element are formed of aluminium.

9. The unit load device according to claim 3, wherein the connecting elements can be pivoted, in respect of their longitudinal extent, in a plane perpendicular to a longitudinal extent of the seat track guide.

10. The unit load device according to claim 6, wherein the second cross-section of the fixing element is rectangle-like.

11. The unit load device according to claim 1, wherein the fixing device is embodied as a strap.

12. The unit load device according to claim 8, wherein the fixing element has a first cross-section which in particular is rectangle-like and at least one first part of the fixing element has a second cross-section, in such a way that a second part of the fixing element can be removed therefrom in order to change the length of the fixing element.

13. The unit load device according to claim 1, wherein the unit load device comprises at least one side wall, and wherein the seat track guides extend along an edge of the side wall.

14. The unit load device according to claim 1, with a fixing device embodied in particular as a strap for fixing the connecting element and the fixing element, wherein the fixing device is arranged on the fixing element and, at its second end, which is opposite the first end, is designed to latch into the seat track guide.

* * * * *